United States Patent [19]

Habegger et al.

[11] 4,448,393

[45] May 15, 1984

[54] APPARATUS FOR PULLING IN AND LETTING OUT A CABLE

[75] Inventors: Willy Habegger, Hünibach; Ernst Lauber, Thun, both of Switzerland

[73] Assignee: Willy Habegger AG, Thun, Switzerland

[21] Appl. No.: 362,120

[22] Filed: Mar. 26, 1982

[30] Foreign Application Priority Data

Mar. 28, 1981 [DE] Fed. Rep. of Germany ..... 3112344

[51] Int. Cl.[3] ..... B66D 3/18

[52] U.S. Cl. ..... 254/264; 254/228; 254/254

[58] Field of Search ..... 254/211, 228, 253, 254, 254/258, 259, 264, 384; 226/112, 115, 158, 162

[56] References Cited

U.S. PATENT DOCUMENTS

| | | | |
|---|---|---|---|
| 3,266,776 | 8/1966 | Catu | 254/228 X |
| 3,602,413 | 8/1971 | Reynard | 226/115 |

FOREIGN PATENT DOCUMENTS

| | | | |
|---|---|---|---|
| 1255269 | 11/1967 | Fed. Rep. of Germany | 254/264 |
| 2252280 | 6/1975 | France | 254/254 |
| 1186244 | 4/1970 | United Kingdom | 254/264 |

*Primary Examiner*—John M. Jillions

*Attorney, Agent, or Firm*—Karl F. Ross; Herbert Dubno

[57] ABSTRACT

An apparatus for hauling in and letting out a flexible element such as a cable comprises a generally stationary housing defining a cable path and having a predetermined number N equal to at least three of grippers spaced in a row and shiftable along the path. These grippers can be clamped on the element in the path by respective actuators which can displace the grippers parallel to the path in a pulling direction and in an opposite letting-out direction. A controller responsive to gripper position and connected to the actuators operates them sequentially. Thus all but one of the grippers is first clamped on the element and the one gripper is unclamped from the element. Then the clamping grippers are displaced by the respective actuators with the element in one direction at a rate $V_w$ through a distance $S/(N-1)$ while simultaneously the nonclamping gripper is displaced oppositely through a distance S along the element at a rate $V_r$ equal substantially to $2 \cdot V_w$ to return this nonclamping gripper to a starting position. Subsequently the nonclamping gripper is closed on the element and the one of the other grippers which follows in the row behind the gripper in the starting position is unclamped. These steps are then sequentially repeated so that the grippers are successively returned to the starting position in an operation cycle having N parts.

12 Claims, 10 Drawing Figures

1
2
2'
2''
3
3'
3''
4
4'
4''
6
7
7'
7''
7a'
7b'
8
8'
8''
8a'
8b'
9
9'
9''
9a'
9b'
10a'
10a''
10b'
10b''
10c'
10c''
11
11'
11''
11a''
12
12'
12''
12a''
13
13'
13''
13a''
14
15
16
17a
17a'
17b
17c
17c'
18a
18b
18c
19
20a
20b
20c
21
23
24
25a
25b
25c
30
41
P
R
S
S/2
Vr
Vw 1
2
3
4
6
7
8
9
10
11
12
13
14
15
16
17
18
19
20
21
23
24
25
30
37
41
P
R

APPARATUS FOR PULLING IN AND LETTING OUT A CABLE

FIELD OF THE INVENTION

The present invention relates to a method of and apparatus for pulling in and letting out a flexible element such as a cable. More particularly this invention concerns a device that is not of the drum or winch type but which can slowly and powerfully pull in or pay out a straight and even tensioned cable or the like.

BACKGROUND OF THE INVENTION

Under many circumstances it is necessary to pull in or pay out a cable or the like but it is impossible to wind this element around a drum. Instead the element must pass under tension straight through the device. Accordingly a device is known which has a normally horizontal lever pivotal about a horizontal transverse axis on a fixed support and having two attachments flanking the pivot. Arms pivoted on the attachments each carry a pair of jaws between which the cable passes, and which automatically lock on and grip the cable when pulled up along it in one direction, but which slide in the other direction. Thus as the lever is rocked back and forth about its axis the cable is first gripped and lifted by one of the grippers while the other slides down it, and then is clenched by the other gripper as it lifts while the one gripper slides down the cable to start lifting again. With a long lever arm the system can exert enormous forces, and can be operated by a crank or hydraulic cylinder for nonmanual operation.

The problem with such an arrangement is that it advances the cable and its load in steps. In addition at any given time only one of the sets of gripper jaws is engaging the cable, so that it must grip it with enormous force, frequently biting into and damaging the cable. The disadvantage of this concentrated gripping force at one location is compounded by the start-and-stop advance. In addition this jerky advance frequently damages the load itself, and subjects the cable to peak loads well in excess of the actual mass being lifted.

OBJECTS OF THE INVENTION

It is therefore an object of the present invention to provide an improved method of and apparatus for hauling in and paying out a cable or the like.

Another object is the provision of such a method and apparatus which overcome the above-given disadvantages.

A further object is to provide a device which smoothly and uniformly displaces a tensioned element such as a cable without subjecting it to sudden peak loads as described above.

SUMMARY OF THE INVENTION

These objects are attained according to the instant invention in an apparatus which comprises a generally stationary housing defining a cable path and having a predetermined number N equal to at least three of grippers spaced in a row and shiftable along the path. These grippers can be clamped on the element in the path by respective actuators which can displace the grippers parallel to the path in a pulling direction and in an opposite letting-out direction. Control means responsive to gripper position and connected to the actuator means operates them in accordance with the method of this invention. Thus all but one of the grippers is first clamped on the element and the one gripper is unclamped from the element. Then the clamping grippers are displaced by the respective actuators with the element in one direction at a rate $V_w$ through a distance $S/(N-1)$ while simultaneously the nonclamping gripper is displaced oppositely through a distance S along the element at a rate $V_r$ equal substantially to $2 \cdot V_w$ to return this nonclamping gripper to a starting position. Subsequently the nonclamping gripper is closed on the element and the one of the other grippers which follows the gripper in the starting position in the row is unclamped. These steps are then sequentially repeated so that the grippers are successively returned to the starting position in an operation cycle having N parts. In a three-gripper system, therefore the two clamping grippers are moved through half the stroke S at half the return rate $V_r$ of the nonclamping gripper which therefore moves through the full stroke S.

With the system according to the instant invention, therefore, the flexible element will be moved uniformly. At any time it will be held by at least two grippers so that the clamping pressure of any one gripper need not be very great. Such uniform and continuous displacement of the flexible element greatly reduces stresses in it and in the load.

According to another feature of this invention the grippers each include a pair of jaws and the actuator means each include respective double-acting fluid work cylinders connected to one of the jaws of the respective grippers for displacing same in both of the directions, and respective single-acting fluid return cylinders connected to the other of the jaws of the respective grippers for displacing same in the other direction toward the starting positions. The control means includes valve means for pressurizing the cylinders, which may be hydraulic or pneumatic. It is also possible to use purely mechanical actuators.

The work cylinders according to the invention have respective front compartments pressurizable to displace the respective grippers in the one direction and depressurizable to displace same in the opposite direction. The valve means include respective throttle valves connected to the front compartments for restricting flow into same and opposite rear compartments. The control means include a common fluid line interconnecting all of the rear compartments. Safety means is provided for closing the throttle valves and stopping flow into or out of all of the front compartments when pressure in the common line or in any of the front compartments drops below a predetermined level. The common line connected to the back compartments ensures that the rear compartment of the returning cylinder will receive all of the fluid forced out of the other rear compartments for perfectly synchronous but opposite displacement of the returning gripper at a speed equal to an appropriate multiple of the rate $V_w$.

According to another feature of this invention the apparatus has a fluid source having a high-pressure side and a low-pressure side and mode valve means connected to the source and to the control means. This mode valve is shiftable between a pulling position connecting the front compartments of the clamping grippers to the high-pressure side, the front compartment of the nonclamping gripper to the low-pressure side, and the return cylinders to the low-pressure side for displacing the element in the pulling direction, and a letting-out position connecting the front compartments and return cylinders of the clamping grippers to the low pressure side and the front compartment and return cylinder of the nonclamping gripper to the high-pressure side. The control means in turn is provided with sensor means for detecting the positions of the grippers and valve means connected between the sensor means and the cylinders and connected to the mode valve for pressurizing the cylinders sequentially in accordance with the positions of the grippers. To this end the control means includes a shaft carrying a plurality of cams having respective abutments and respective stops engageable with the abutments and displaceable by the grippers into and out of engagement with the respective cams in respective positions of the respective grippers, although it would be within the scope of this invention to replace this mechanical arrangement with an electronic one using reed switches or the like to detect gripper position. This control means also has respective emergency end valve means engageable by the grippers when same reach the end of their travel in the letting-out direction for stopping displacement of the grippers.

Flow into and out of the front compartments of the work cylinders is through respective closable throttle valves that shut whenever pressure drops too low in the respective front or rear compartment. Thus if the device malfunctions, it will lock onto the cable, eliminating any possibility of accident.

Each of the grippers according to this invention has a pair of jaws and a parallelogrammatic linkage interconnecting same, although it would be possible to use rotary cam-type grippers or other known systems. Each jaw-type gripper includes removable bolts securing one of the respective jaws to the respective linkage. Thus the one jaws can be removed for threading a cable or the like through the apparatus. At least one spring in each gripper urges the respective jaws toward each other, that is in a direction clamping the element between them.

DESCRIPTION OF THE DRAWING

The above and other features and advantages will become more readily apparent from the following, reference being made to the accompanying drawing in which.

SPECIFIC DESCRIPTION

Figure 1:
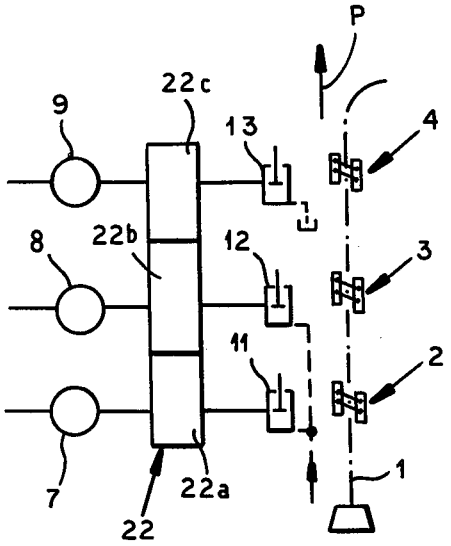
FIG. 1 is a diagrammatic side view of a three-gripper system according to this invention.
Figure 2:
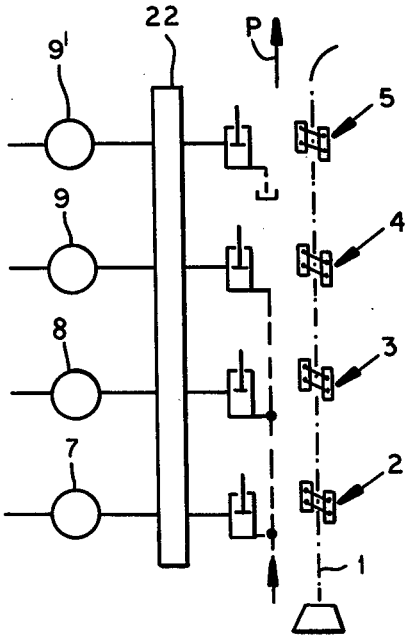
FIGS. 2 and 2*a* are a view and graph like FIGS. 1 and 1*a*, respectively, but showing a four-gripper system.
Figure 3:
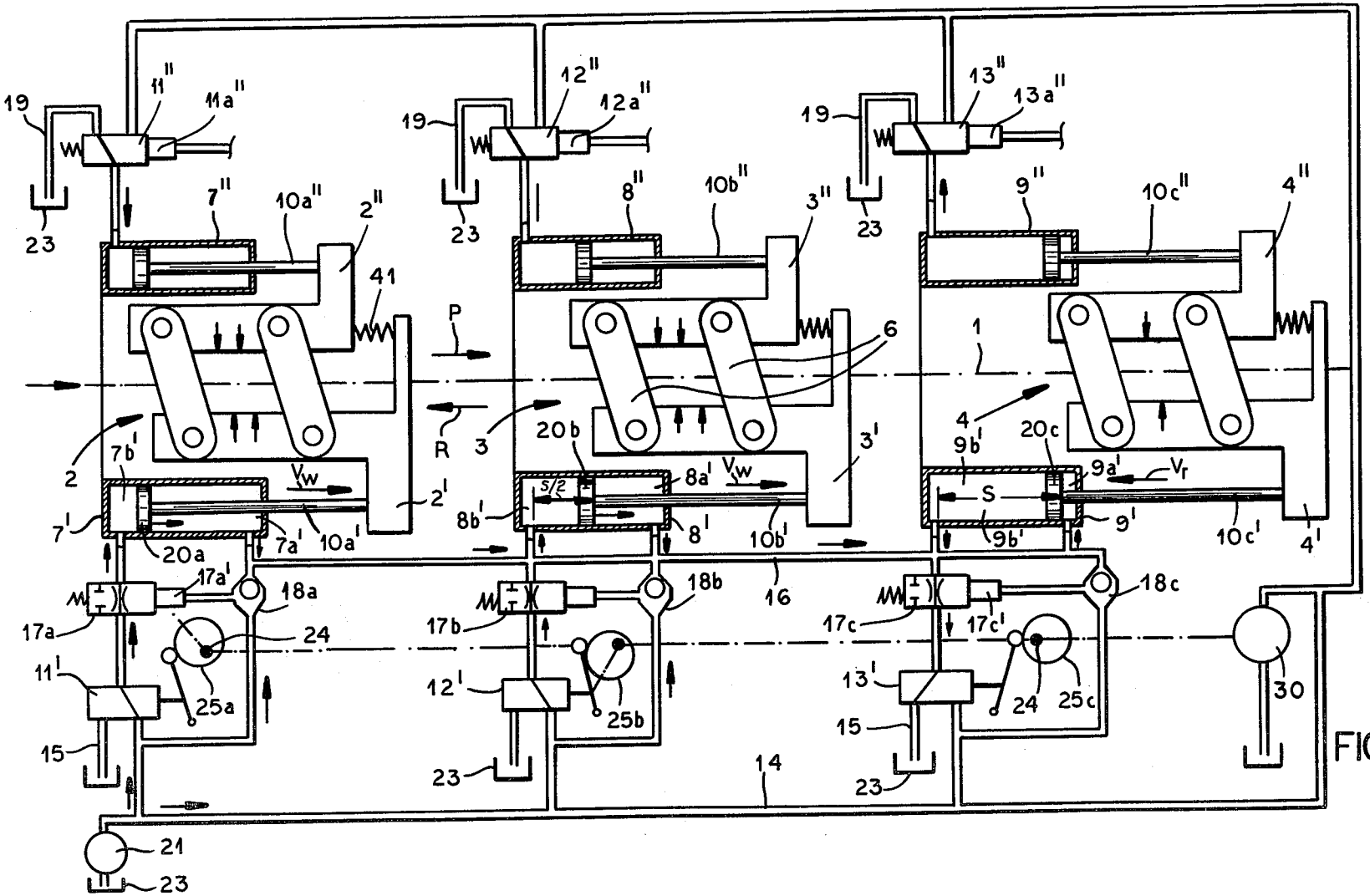
FIG. 3 is another diagrammatic view of the hydraulic elements of the three-gripper system of this invention in somewhat more detail than the view of FIG. 1, and showing the system in the lifting position.
Figure 4:
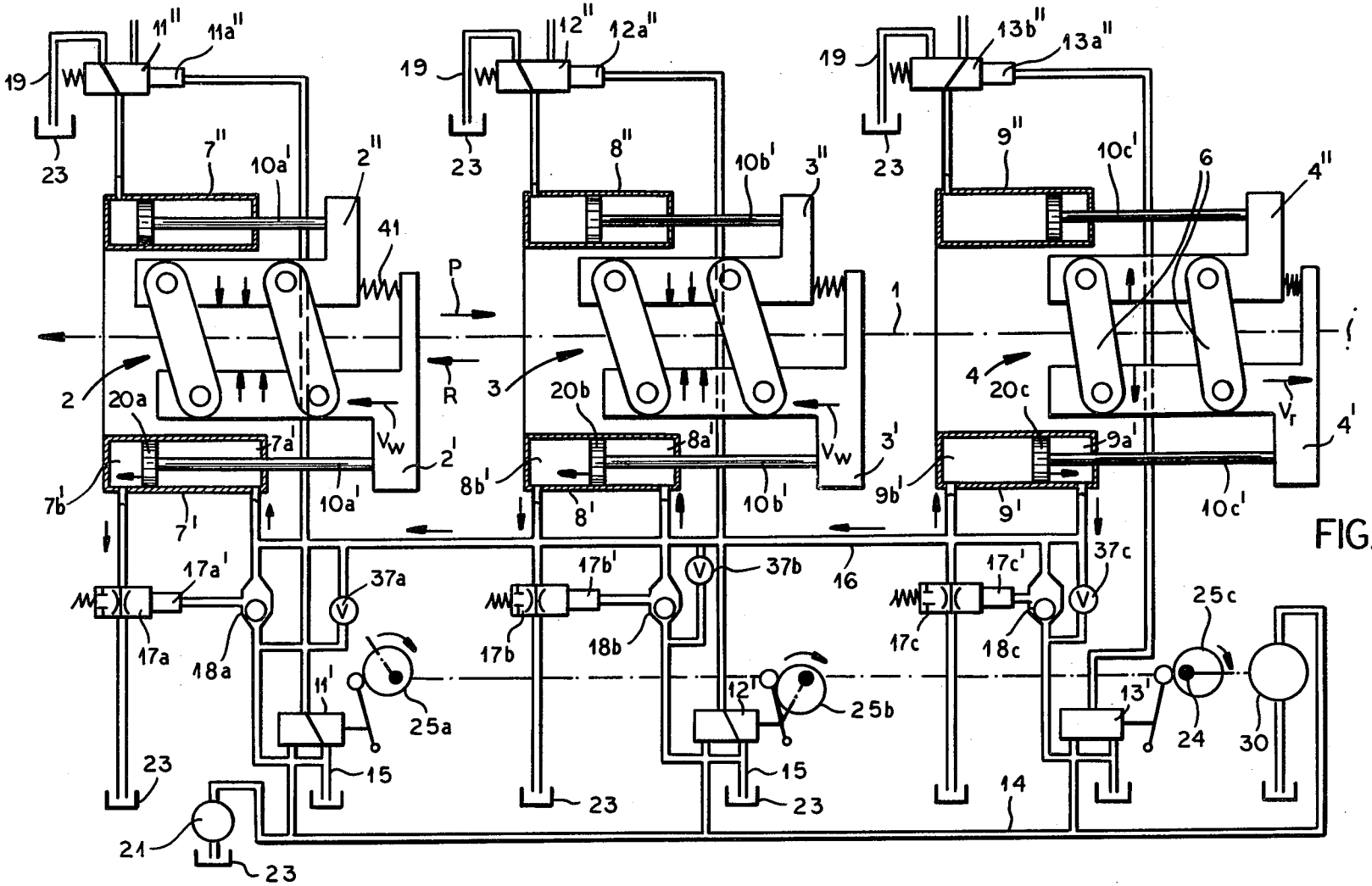
FIG. 4 is a view like FIG. 3 but showing the system in the lowering or paying-out position.

As seen in FIGS. 1–4 an apparatus according to the instant invention is intended to act on a cable 1 either to pull or haul it in, upward in FIGS. 1 and 2 and from right to left in FIGS. 3 and 4 as indicated by arrow P, or to release it or let it out, downward in FIGS. 1 and 2 and from left to right in FIGS. 3 and 4 as indicated by arrow R. This apparatus has either three grippers or sets of jaws 2, 3, 4 as shown in FIGS. 1, 3, and 4, or four jaw sets 2, 3, 4, and 5 as seen in FIG. 2.

Figure 1A:
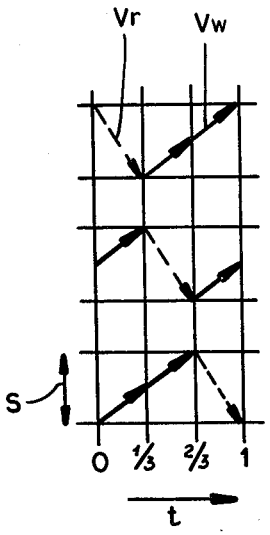
FIG. 1*a* is a graph illustrating the operation of the system of FIG. 1.

The operation of the three-gripper system of FIG. 1 is illustrated in FIG. 1*a* where each curve of the graph represents the travel of the gripper level with it in FIG. 1. A full operation cycle, indicated on the abscissa, is subdivided into three equal parts. The stroke S of the jaws during one such cycle is indicated on the ordinate. Thus with this system two of the grippers are closed on the cable 1 and are moving with it, and the third gripper is moving oppositely relative to the cable 1 during any given one-third cycle. The rate $V_r$ of displacement during the return stroke (indicated in dashed lines) is two times the rate of displacement $V_w$ during the work stroke (indicated in solid lines), so that as two of the grippers are engaged with the cable to lift or lower it through a distance S/2 the third gripper moves oppositely through the full stroke S.

Figure 2A:
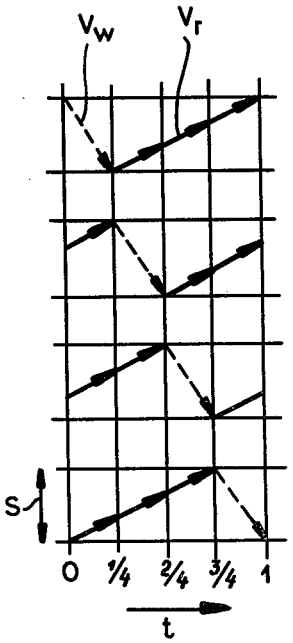

The same style of operation is followed by the four-gripper arrangement of FIGS. 2 and 2*a*. Here, however, the full cycle is subdivided into four parts so that while three of the grippers are moving the cable through S/3, the fourth is returning through the full stroke S, and the return rate $V_r$ is three times the work rate $V_w$.

Thus, generally speaking, in a system with a number N equal to three or more grippers and a return stroke S, the work stroke is equal to $S/(N-1)$. For example in an arrangement with seven grippers, the work stroke would be one-sixth the return stroke, and the return rate $V_r$ would be six times faster than the displacement rate $V_w$ on the work stroke. The discussion below relates solely to the three-gripper model of FIGS. 1 and 1*a*, but is not intended to limit the invention to such an arrangement, as the person skilled in the art can easily adapt the teachings from a three-gripper arrangement to four or more.

As also seen in FIGS. 3 and 4 each of the grippers 2, 3, and 4 comprises a respective pair of jaws 2', 2''; 3', 3''; and 4', 4''. Parallel levers 6 connect each of the jaws 2', 3', and 4' to its mate 2'', 3'', and 4'' to act as a parallelogrammatic linkage. The grippers 2, 3, and 4 as seen in FIG. 1 are operated by respective hydraulic actuator systems 7, 8, and 9 in turn controlled by respective valve systems 11, 12, and 13 and a main mode or switch-over valve 22 shown in detail only in FIG. 8. Springs 41 urge the lower jaws 2', 3', and 4' in the direction P and the upper jaws 2'', 3'', and 4'' in the direction R to close the respective grippers 2, 3, and 4. The fourth gripper 5 of FIG. 2 is operated by a respective hydraulic actuator 9' operated in turn by a valve like the valve 13.

The hydraulic actuators 7, 8, and 9 include as seen in FIGS. 3 and 4 double-acting work cylinders 7', 8', and 9' having pistons 20*a*, 20*b*, and 20*c* whose piston rods 10*a*', 10*b*', and 10*c*' are connected to the respective lower jaws 2', 3', and 4'. These cylinders 7', 8' and 9' have rear or piston-rod-side compartments 7*a*', 8*a*', and 9*a*' all connected together by a common hydraulic line 16 and pressurizable to open the respective grippers 2, 3, and 4 and return them in the direction R and front compartments 7b', 8b', and 9b' pressurizable to close them and displace them in the pulling direction P. In addition the actuators 7, 8, and 9 include single-acting return cylinders 7", 8", and 9" having piston rods 10a", 10b", and 10c" connected to the upper jaws 2", 3", and 4" for displacing them in the pulling direction P, which action will, because of the parallelogrammatic linkage 6, open the grippers 2, 3, and 4. Obviously the effective surface areas of the faces of the pistons 20a, 20b, and 20c are different, with the faces exposed in the back compartments 7a', 8a', and 9a' substantially smaller than the opposite ones.

The valve assemblies 11, 12, and 13 include three-port two-position main valves 11', 12', and 13' and three-port two-position secondary valves 11", 12" and 13", the latter having pilot ports 11a", 12a", and 13a". The main valves 11', 12', and 13' are connected on one side via the mode valve 22 shown in FIG. 8 either to the respective front compartments 7b', 8b', and 9b' as shown in FIG. 3 or to the respective pilot ports 11a", 12a", and 13a" as shown in FIG. 4, and on the other side to a high-pressure line 14 fed from a pump 21 and to a low-pressure line 15 connected to a sump 23.

In addition throttle-type valves 17a, 17b, and 17c are provided between the front compartments 7b', 8b', and 9b' and the valve 22 (FIG. 8) for connection in the lifting mode of FIG. 3 to the respective main valve 11, 12, or 13, or in the lowering or paying-out mode of FIG. 4 to the low-pressure line 15 leading to the sump 23. These throttle valves 17a, 17b, and 17c have respective pilot ports 17a', 17b', and 17c' which when pressurized allow throttled flow through the respective valves 17a, 17b, and 17c, but when unpressurized all flow through them is blocked. Respective double check valves 18a, 18b, and 18c each have one input connected to the common line 18, another input connected through the valve 22 either to the high-pressure line 14 or to the low-pressure line 15, and an output connected to the respective pilot port 17a', 17b', and 17c'. These valves 17a–c and 18a–c serve a safety function, by stopping flow into or out of all of the compartments 7b'–9b' whenever pressure fails in the high-pressure drive line 14 during lifting or in the common line 16 during lowering. They also throttle flow out of the front compartments 7b', 8b', and 9b' during lowering to establish lowering speed.

The valves 11, 12, and 13 are operated in accordance with the positions of the respective grippers 2, 3, and 4 by a cam-type control arrangement described in greater detail below with reference to FIG. 5 as the device steps through its operation cycle, being switched one after the other from a position connecting the respective compartment 7b', 8b', and 9b' to the high-pressure line 14 to one connecting it to the low-pressure line 15. To this end these valves 11, 12, and 13 are operated by respective cam disks 25a, 25b, and 25c equiangularly eccentrically offset on a shaft 24 rotated by a motor 30 and arrestable when the jaws 2, 3, and 4 go out of synchronization as will be described below.

The valve 22 comprises ganged parts 22a, 22b, and 22c forming parts of the respective hydraulic valve assemblies 7, 8, and 9. These parts 22a, 22b, and 22c are all identical. Part 22a, as shown in FIG. 8, is a six-port two-position slide valve connected on one side to the main control valve 11', the line 25 to the sump 23, and the line 14 to the pump 21 and on the other side to the throttle safety, valve 17a, to the double check valve 18a, and to the pilot or operating port 11a" of the second control valve 11".

Figure 8:
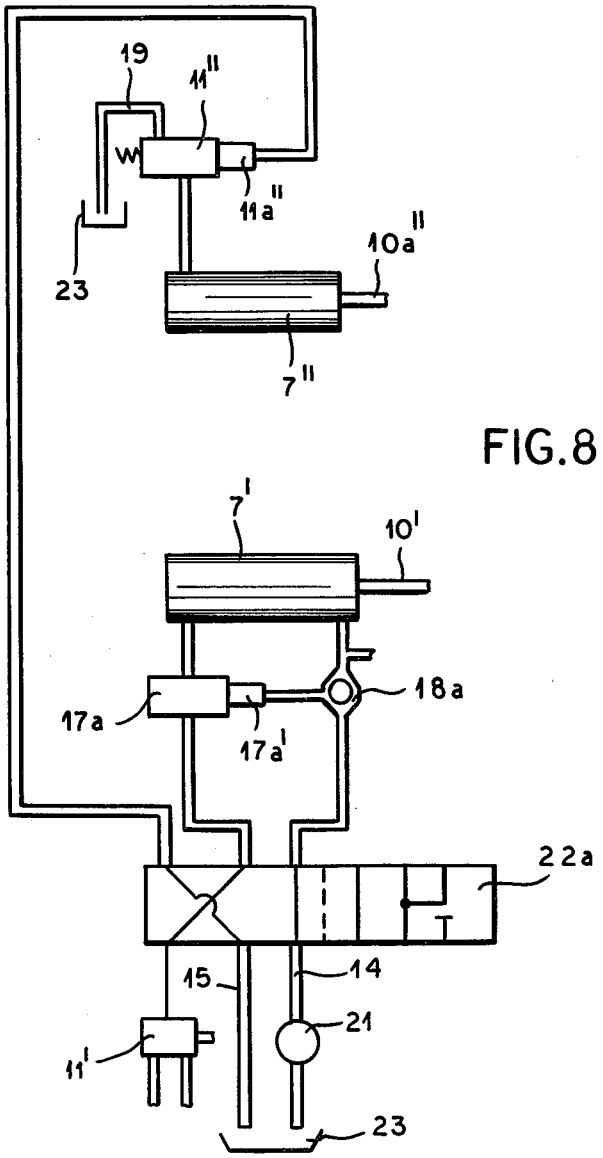
FIG. 8 is another diagrammatic view of a portion of the hydraulic elements of this invention not shown in FIGS. 3 or 4.

To lift or pull an object connected to the cable 1 in the direction P the pump 21 is operated continuously and the mode valve 22 is moved so that each section 22a, 22b, and 22c is in the position indicated in FIG. 8 for section 22a. In this lift position whose connections are shown in FIG. 3, although the valve 22 is not illustrated there for clarity of view, the high-pressure line 14 is connected to an input of the double-check valve 18a, the low-pressure line 15 to the pilot port 11a" of the valve 11", and the main control valve 11' through the safety valve 17a to the actuator 7'. Then—assuming that all the various elements are in the position of FIG. 3 with the piston 20a to the far left, the piston 20b in the middle, the piston 20c to the far right, the valves 11' and 12' connecting the respective actuators 7' and 8' to the high-pressure line 14, and the valve 13' connecting its actuator 9' to the sump 23—the pressurized front compartments 7b' and 8b' will force the respective pistons 20a, and 20b to the right as seen in FIG. 3, that is in the pull direction P. This action will clamp the respective grippers 2 and 3 tightly on the cable 1 and move the cable 1 with the two grippers 2 slowly to the right. The valves 17a, 17b, and 17c will meanwhile be open, but will be throttling the flow to the compartments 7b', 8b, and 9b' somewhat. The pressure from the line 14 will be pushing up the balls of the valves 18a, blocking input from the common line 16, since the pressure in this line 16 is the same as that of the back compartments 7a', 8a', and 9a' which in turn is roughly equal to that in the compartments 7b' and 8b' which itself is lower than that of the line 14 because of the throttles 17a and 17b.

Meanwhile the third main control valve 13' is, as a result of the position of its cam 25c, in the opposite position in which it connects its compartment 9b' to the sump 23. The relatively high pressure in the line 16 therefore is effective in the piston-rod compartment 9a' to move the piston 20c toward the left, emptying the compartment 9b' into the sump 23. Since the compartment 9b' will be receiving all of the liquid driven out of both of the compartments 7b' and 8b', it will move in the direction R at a rate $V_w$ equal to twice their displacement rate $V_r$.

Thus as the two pistons 20a and 20b and their respective grippers 2 and 3 move through half of their strokes S in the direction P, hauling in the cable 1, the third piston 20c and its gripper 3 return through the entire stroke S in the direction R twice as fast. When the piston 20a is in the middle, the piston 20b at the far right, and the piston 20c at the far left, the cams 25a, 25b, and 25c jointly step through 120° to reverse the positions of the valves 12' and 13', thereby pressurizing the compartment 9b' and depressurizing the compartment 8b' for another half stroke. Thereafter the valves 11' and 12' are reversed for the third part of the cycle, whereupon the above-described operations can take place over again.

During the entire cycle the valves 11", 12", and 13" connect the respective actuators 7", 8", and 9" via lines 19 to the sump 23 so that at any given time one of these actuators 7", 8", and 9" is expelling liquid into the sump 23 at a rate equal to twice that at which the other two are sucking liquid from it. These valves 11", 12", and 13" therefore play no part in a lifting operation.

For lowering, the mode valve 22 moves to the opposite position in which, as can be inferred from FIG. 8 and as is illustrated in FIG. 4, the lower inputs of the double check valves 18a, 18b, and 18c and the compartments 7a', 8a', and 9a' are connected to the sump 23, the latter via the respective throttle valves 17a, 17b, and 17c. In addition the valves 11', 12', and 13' are connected to the pilot ports 11a'', 12a'', and 13a'' of the respective secondary control valves 11'', 12'', and 13''.

Thus, assuming that the parts of the apparatus are starting in the position of FIG. 4 which is the same as the starting position shown in FIG. 3, the two grippers 2 and 3 will clench the cable 1 and move slowly toward the left, as the actuators 7'' and 8'' and the compartments 7b, and 8b' are largely depressurized. The throttle effect of the valves 17a and 17b will limit the displacement in the direction R to the rate $V_w$, the same as the displacement rate in the opposite direction during lifting.

Meanwhile the valve 13' is operating the valve 13'' to pressurize the actuator 9'' with the full pressure of the line 14, thereby urging the jaw 4'' to the right in direction P. The gripper 3 will open and the force from the actuator 9'' will, when the gripper 3 is totally open, be transmitted through the bottoming spring 41 to the jaw 4' to move it also to the right, thereby forcing the piston 20c in a direction decreasing the volume of its chamber 9a' and increasing that of its chamber 9b'. Hence the chamber 9b' will suck up liquid from the sump 23 through the respective valve 17c and the liquid forced out of the chamber 9a' will flow through the line 16 into the chambers 7a' and 8a. Once again, the rate $V_w$ of displacement in the releasing direction R will be half that of the rate $V_r$ in the pulling direction 9. The cable 1 will therefore move with the grippers 2 and 3 slowly to the left through a distance S/2 while the gripper 4 will slide oppositely but twice as fast through the full stroke S.

As this occurs the line 16 will be under sufficient pressure to hold the valves 17a, 17b, and 17c open, since the other inputs of the double check valves 18a, 18b, and 18c are connected to the sump 23. Once the returning piston, here the piston 20c, reaches the end of its return stroke, if the machine does not step to the next part of its cycle the pressure will drop precipitously in the line 16, thereby closing the valves 17a, 17b, and 17c and solidly arresting the cable 1.

In addition the grippers 2, 3, and 4 are associated at least when lowering with respective emergency valves 37a, 37b, and 37c connected between the common line 16 and the sump 23. These valves 37a, 37b, and 37c only open when the respective grippers move in the pay-out direction R past predetermined end positions a little short of the physical limit of their travel in the direction R. Thus if, for instance, the gripper 2 in the position of FIG. 4 reaches its left-hand end position before the gripper 4 has moved all the way to the right, the valve 37a will open, which action will depressurize the line 16 to open the valves 17a–c and thereby stop the two grippers 2 and 3 from moving at all, while still allowing the returning gripper 4 to move into its end position and clamp on the cable 1. As will be described below with reference to FIG. 5, the machine will be able to start up again with no problem, as the machine will step to the next part of the cycle so that the cylinder 7'' will be pressurized to unclamp and move up the too low gripper 2. Since this overtravel is only a problem with the lower of the two holding grippers, which is always the next one to be returned, a minor malfunction of this type creates no problem, as the machine can virtually cure itself and reestablish synchronous action.

When as seen in FIG. 4 during lowering the upper holding gripper 3 slips on the cable to shoot past its end position in the direction R it will prevent the device from shifting to its next part of the cycle, causing the grippers 2 and 4 to move far enough to actuate their emergency valves, again bringing lowering to a halt. The gripper 2 will be carrying the entire load, so that its valve 17a will open quite a bit while the valve 17b will close, as a result of the valve type and difference in pressures between the actuators 7', 8', and 9'. Meanwhile the gripper 4 will have returned to its upper position to clamp on the cable 1, but the machine will be unable to step into the next phase of its cycle for reasons described below with reference to FIG. 5, so that the device will have to be checked and manually restarted. In this manner dangerous accidents that can occur when a greasy or icy cable portion comes into the pulling or lowering apparatus can be avoided.

During lifting or pulling such problems are not possible since the grippers automatically lock in this direction on the cable if it starts to slip at all, for whatever reason. In addition if the grippers overtravel while pulling, they will simply stop and the cable will slide relative to them.

Figure 5:
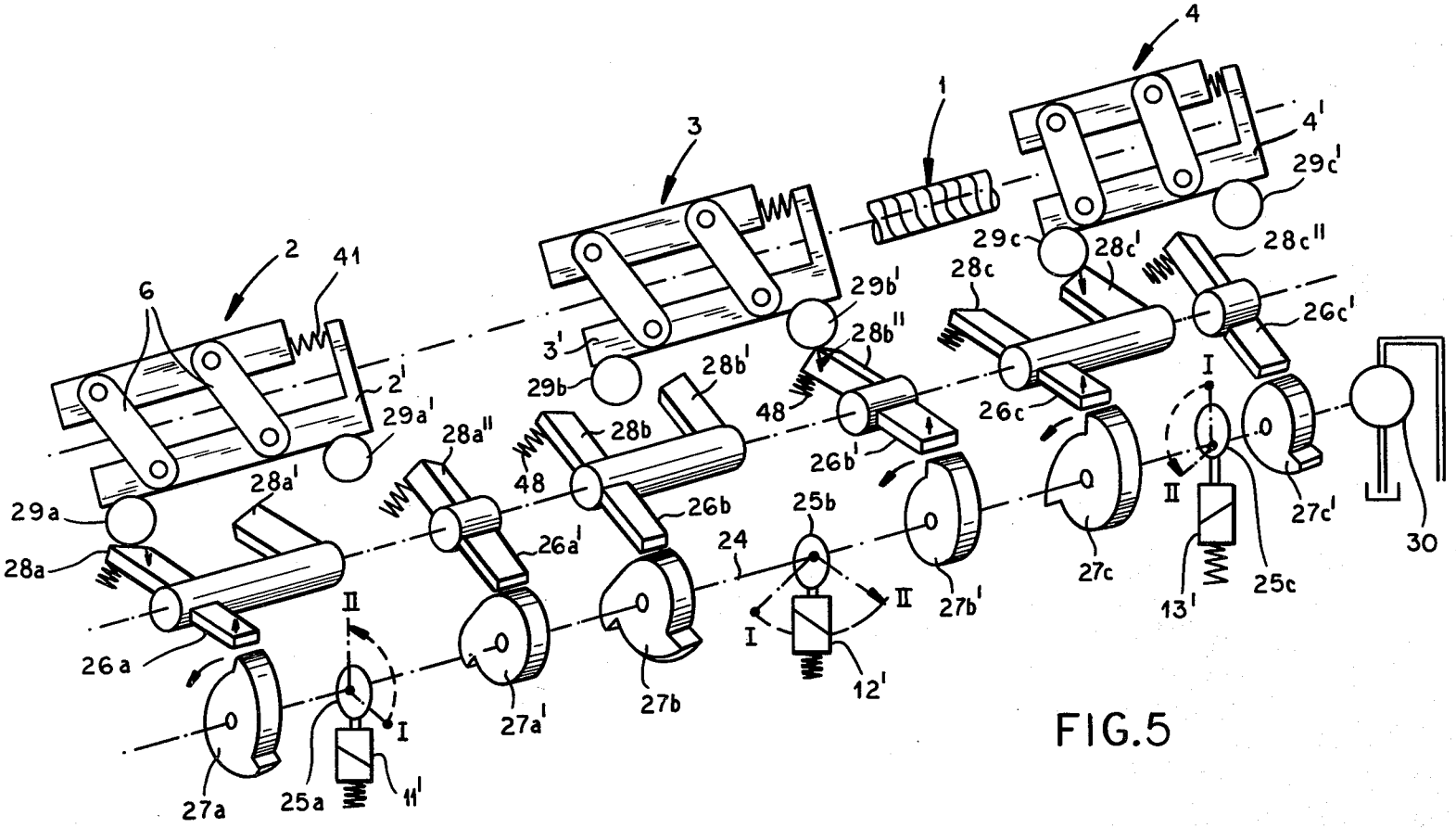
FIG. 5 is a perspective and partly diagrammatic view of the cam-type rotary stepping system of this invention.

FIG. 5 shows the elements which step the machine through its work cycle, which operation it is noted normally is smooth and continuous for uniform displacement of the cable 1 so that even though the grippers 2–4 are themselves moving in steps, the cable 1 moves uniformly at the rate $V_w$. The shaft 24 carries, in addition to the cams 25a, 25b, and 25c of the valves 11', 12', and 13' respective two-abutment cams 27a, 27b, and 27c and one-abutment cams 27a', 27b', and 27c'. Respective coaxially pivotal stops 26a–c and 26a'–c', are engageable with the abutments of the cams 25a–c and 25a'–c' to arrest the shaft 24 when any of the stops engages its respective abutment. Springs 48 urge the stops 26a–c' radially into engagement with the respective cams 25a–c'.

The jaws 2', 3', and 4', which can move parallel to the axes of the pivotal cams 26a–26c' and to the shaft 24, carry respective ball-type actuators 29a, 29a'; 29b, 29b'; and 29c, 29c'. The actuators 29a, 29b, and 29c are engageable with respective arms 28a, 28a'; 28b, 28b'; and 28c, 28c' of the stops 26a, 26b, and 26c in the end and middle positions, respectively, of the respective grippers 2, 3, and 4 to arrest the respective cams 27a, 27b, and 27c. In addition the actuators 29a', 29b', and 29c' are engageable with respective arms 28a'', 28b'', and 28c'' of the stops 26a', 26b', and 26c' to arrest the respective cams 27a', 27b', and 27c' in the opposite end positions of the respective grippers 2, 3, and 4.

The abutments of each of the cams 27a–27c' are angularly equispaced about the shaft 24. They are further positioned such that the shaft 24 can only rotate about its axis when one of the grippers 2–4 is in the one end postion, the next is in the middle position, and the third is in the opposite end position.

More particularly, in the position of FIG. 5 the grippers 2–4 are in the same relative positions as in FIGS. 3 and 4. In this position the actuator 29a holds the stop 26a up out of contact with the cam 27a, the actuator 29b' holds the stop 26b' up out of contact with its cam 27b', and the actuator 29c holds its stop 26c up out of contact with its cam 27c. The stops 26a', 26b, and 26c' are meanwhile engaging the respective cams 27a', 27b, and 27c' at locations where they have no abutments. Thus in this position there is nothing impeding rotation of the shaft 24. Should any of the grippers be seriously ahead of or behind its synchronous position, the shaft 24 will be arrested and the system will not step to the next part of its cycle. This cam arrangement is deliberately made relatively insensitive as far as the middle positions of grippers 2–4 read by the arms 28a', 28b', and 28c', so that it does not block the shaft 24 for minor asynchronous action, in order to permit smooth functioning of the apparatus.

Under normal circumstances the device will function continuously, with each gripper moving through its full stroke, during half of which one of the other two grippers is returning and the other is assisting in pulling, and during the other half of which the one of the other two is assisting and the other is returning. The hydraulic link formed by the line 16 automatically ensures synchronous displacement under most circumstances. The purpose of the cam arrangement shown in FIG. 6 is mainly to prevent one of the grippers 2–4 from ever having to carry the entire load itself.

Figure 6:
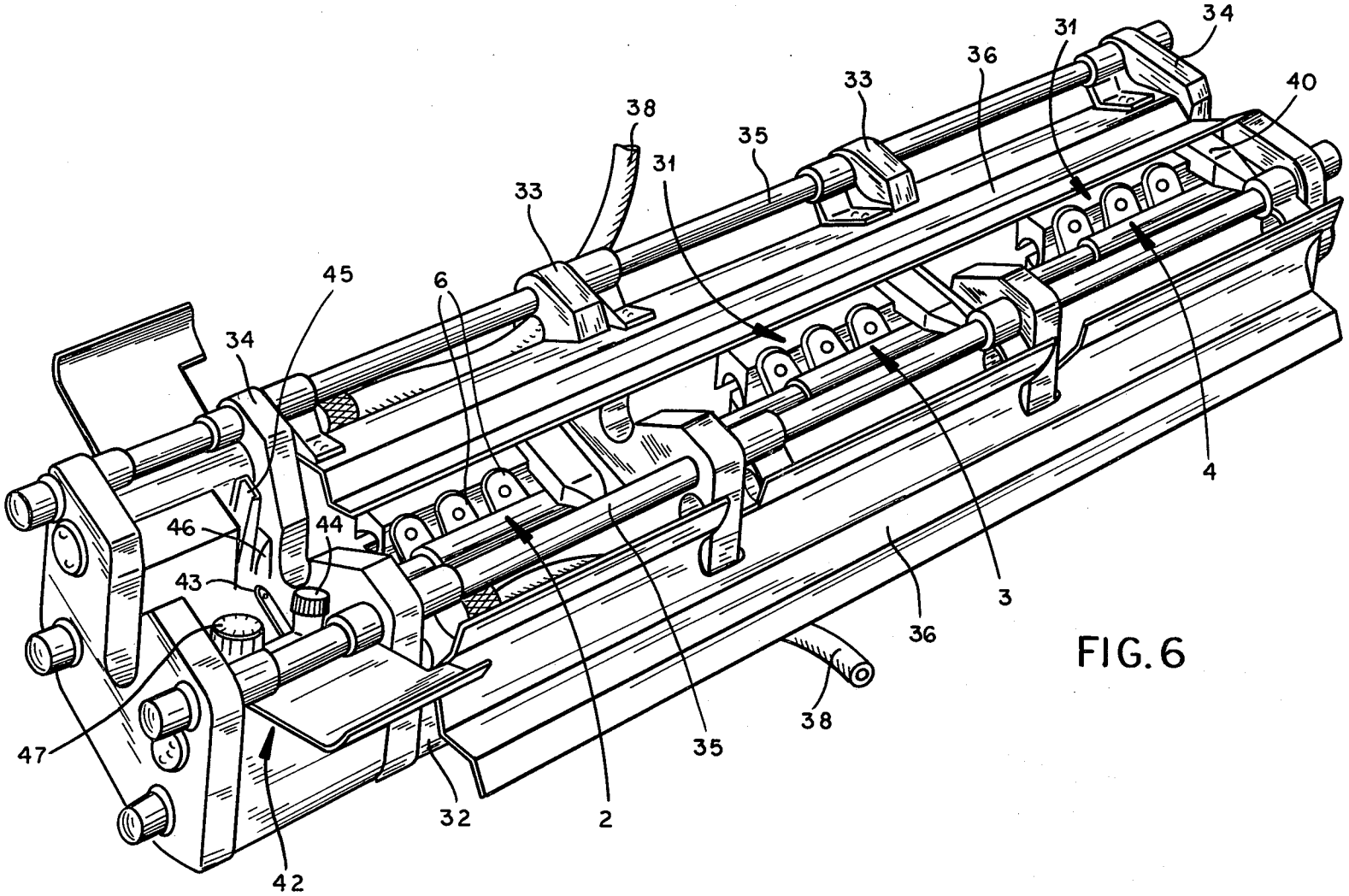
FIG. 6 is a perspective view of the apparatus of the invention.
Figure 7:
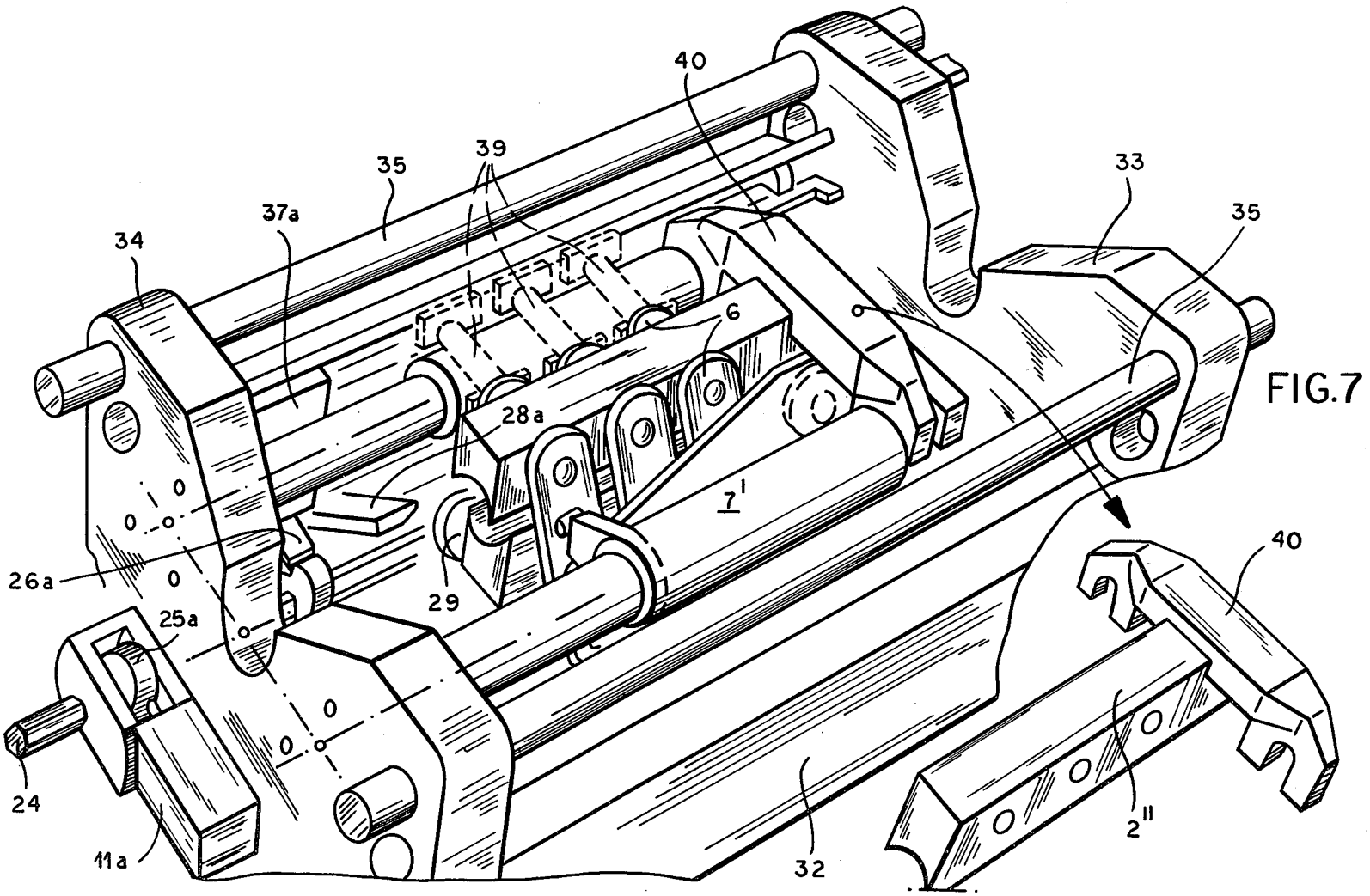
FIG. 7 is a large-scale view of a detail of FIG. 6.

FIGS. 6 and 7 show the structural details of the apparatus of this invention, it being noted that the grippers and their related parts are substantially identical. The arrangement has a housing 32 provided with respective slides 31 carrying the grippers 2, 3, and 4. Between adjacent slides 31 the housing 32 has transverse walls or webs 33 and also had end walls or webs 34 in which parallel tie rods 35 on which the slides 31 can move are anchored. Covers 36 can be pivoted over the channel forming the cable-receiving trough or path of the apparatus. Hydraulic feed lines 38 are connected to the various devices, and the end walls 34 are set up for connection of appropriate wheels or rollers of a pulley block. The upper jaws 2'', 3'', and 4'' are removable, to which end they are secured by removable bolts 39 to the parallelogrammatic links 6, with yokes 40 connecting them to the respective cylinders 7'–9'', which themselves are of the telescoping type.

One end of the housing 32 acts as a control unit 42 with a reversing lever 43 for momentary opposite displacement, a bypass throttle 44 for gentle starting or stopping, a valve lever 45 for simultaneous opening of all the grippers 2–4, a safety device 46 to prevent opening of the grippers when under load, and a flow regulator 47 to synchronize two such devices.

It is also within the scope of this invention to have more main working cylinders 7'–9' than return cylinders 7''–9'', with such work cylinders distributed symmetrically about the cable axis. The reversal of the hydraulic system between lifting and sinking modes can also be effected by reversal of the flow direction in the hydraulic conduits extending between the pump and the pulling apparatus, or even manually or remotely controlled directly at the pulling device.

With the system according to the instant invention it is possible to pull in or pay out a cable 1 with considerable force. The cable 1 is moved with a nearly perfectly uniform speed and is always held by at least two grippers, so that it will not be damaged by such grippers. The uniformity of displacement will also protect the load against jarring, and will eliminate the creation of high peak loads that cause the grippers to bite into the cable.

We claim:

1. An apparatus for pulling in and letting out a flexible element such as a cable, said apparatus comprising:

a generally stationary housing defining a cable path;

a predetermined number N equal to at least three of grippers spaced in a row and shiftable along said path, said grippers being clampable on said element in said path;

respective actuator means connected to said grippers for shifting same parallel to said path in a pulling direction and in an opposite letting-out direction; and control means responsive to gripper position and connected to said actuator means for (a) clamping all but one of said grippers on said element and unclamping said one gripper from said element, (b) displacing the clamping grippers with said element in one direction at a rate $V_w$ through a distance $S/(N-1)$ while simultaneously displacing the nonclamping gripper oppositely through a distance S along said element at a rate $V_r$ equal substantially to $2 \cdot V_w$ to return the nonclamping gripper to a starting position; and (c) thereafter clamping said nonclamping gripper on said element and unclamping the one of the other grippers which follows the gripper in said starting position in said row and sequentially repeating steps (b) and (c), whereby said grippers are successively returned to said starting position in an operation cycle having N parts.

2. The apparatus defined in claim 1 wherein said grippers each include a pair of jaws and said actuator means each include:

respective double-acting fluid work cylinders connected to one of the jaws of the respective grippers for displacing same in both of said directions; and respective single-acting fluid return cylinders connected to the other of the jaws of the respective grippers for displacing same in said other direction toward said starting positions, said control means including valve means for pressurizing said cylinders.

3. The apparatus defined in claim 2 wherein said double-acting cylinders have respective front compartments pressurizable to displace the respective grippers in said one direction and depressurizable to displace same in said opposite direction, said valve means including respective throttle valves connected to said front compartments for restricting flow into same and opposite rear compartments, said control means including a common fluid line interconnecting all of said rear compartments.

4. The apparatus defined in claim 3, further comprising safety means for closing said throttle valves and stopping flow into or out of all of said front compartments when pressure in said common line or in any of said front compartments drops below a predetermined level.

5. The apparatus defined in claim 3, further comprising a fluid source having a high-pressure side and a low-pressure side and mode valve means connected to said source and to said control means and shiftable between:

a pulling position connecting the front compartments of the clamping grippers to said high-pressure side, said front compartment of the nonclamping gripper to said low-pressure side, and said return cylinders to said low-pressure side for displacing said element in said pulling direction, and a letting-out position connecting the front compartments and return cylinders of the clamping grippers to said low pressure side and the front compartment and return cylinder of the nonclamping gripper to said high-pressure side.

6. The apparatus defined in claim 5 wherein said control means includes sensor means for detecting the positions of said grippers and valve means connected between said sensor means and said cylinders and connected to said mode valve for pressurizing said cylinders sequentially in accordance with the positions of said grippers.

7. The apparatus defined in claim 6 wherein said control means includes respective emergency end valve means engageable by said grippers when same reach the end of their travel in said letting-out direction for stopping displcement of said grippers.

8. The apparatus defined in claim 3 wherein each of said grippers includes a pair of jaws and a parallelogrammatic linkage interconnecting same.

9. The apparatus defined in claim 8 wherein each gripper includes removable bolts securing one of the respective jaws to the respective linkage, whereby said one jaws can be removed for threading a cable or the like through said apparatus.

10. The apparatus defined in claim 8 wherein each of said grippers includes at least one spring urging the respective jaws toward each other.

11. A method of hauling in and paying out a flexible element such as a cable, said method comprising the steps of:

(a) clamping all but one of a plurality N equal to at least three of a row of grippers on said element and unclamping said one gripper from said element;

(b) displacing the clamping grippers with said element in one direction at a rate $V_w$ through a distance $S/(N-1)$ while simultaneously displacing the nonclamping gripper oppositely through a distance S along said element at a rate $V_r$ equal substantially to $2 \cdot V_w$ to return the nonclamping gripper to a starting position;

(c) thereafter clamping said nonclamping gripper on said element and unclamping the one of the other grippers which follows the gripper in said starting position in said row and sequentially repeating steps (b) and (c), whereby said grippers are successively returned to said starting position in an operation cycle having N parts.

12. An apparatus for pulling in and letting out a flexible element such as a cable, said apparatus comprising:

a generally stationary housing defining a cable path;

a predetermined number N equal to at least three of grippers spaced in a row and shiftable along said path, said grippers each having a pair of jaws clampable on said element in said path;

respective actuator means connected to said grippers for shifting same parallel to said path in a pulling direction and in an opposite letting-out direction, said actuator means each including respective double-acting fluid work cylinders connected to one of the jaws of the respective grippers for displacing same in both of said directions, and respective single-acting fluid return cylinders connected to the other of the jaws of the respective grippers for displacing same in said other direction toward respective starting positions; and control means responsive to gripper position, including valve means for pressurizing said cylinders, and connected to said actuator means for (a) clamping all but one of said grippers on said element and unclamping said one gripper from said element, (b) displacing the clamping grippers with said element in one direction at a rate $V_w$ through a distance $S/(N-1)$ while simultaneously displacing the nonclamping gripper oppositely through a distance S along said element at a rate $V_r$ equal substantially to $2 \cdot V_w$ to return the nonclamping gripper to the respective starting position; and (c) thereafter clamping said nonclamping gripper on said element and unclamping the one of the other grippers which follows the gripper in said starting position in said row and sequentially repeating steps (b) and (c), whereby said grippers are successively returned to said starting position in an operation cycle having N parts, said control means including a shaft carrying a plurality of cams having respective abutments and respective stops engageable with said abutments and displaceable by said grippers into and out of engagement with the respective cams in respective positions of the respective grippers.

* * * * *